US010538823B2

(12) United States Patent
Tanaka et al.

(10) Patent No.: US 10,538,823 B2
(45) Date of Patent: Jan. 21, 2020

(54) STEEL SHEET AND A METHOD FOR ITS MANUFACTURE

(75) Inventors: Yasuaki Tanaka, Osaka (JP); Toshiro Tomida, Osaka (JP); Kaori Kawano, Osaka (JP)

(73) Assignee: NIPPON STEEL CORPORATION, Tokyo (JP)

( * ) Notice: Subject to any disclaimer, the term of this patent is extended or adjusted under 35 U.S.C. 154(b) by 941 days.

(21) Appl. No.: 13/699,845

(22) PCT Filed: May 27, 2010

(86) PCT No.: PCT/JP2010/059013
§ 371 (c)(1),
(2), (4) Date: Feb. 5, 2013

(87) PCT Pub. No.: WO2011/148490
PCT Pub. Date: Dec. 1, 2011

(65) Prior Publication Data
US 2013/0192724 A1 Aug. 1, 2013

(51) Int. Cl.
*C22C 38/00* (2006.01)
*C22C 38/02* (2006.01)
(Continued)

(52) U.S. Cl.
CPC ..... *C21D 8/0263* (2013.01); *C22C 38/001* (2013.01); *C22C 38/002* (2013.01);
(Continued)

(58) Field of Classification Search
CPC ..... C22C 38/22; C22C 38/38; C22C 38/28; C22C 38/001; C22C 38/002;
(Continued)

(56) References Cited

U.S. PATENT DOCUMENTS 6,083,455 A * 7/2000 Kurita et al. ..... 420/126
6,290,784 B1 * 9/2001 Yasuhara ..... C21D 8/0226 148/320
(Continued)

FOREIGN PATENT DOCUMENTS

JP H05148579 * 6/1993
JP 2000-073152 3/2000
(Continued)

OTHER PUBLICATIONS

JP2008-231480 machine translation (published Oct. 2, 2008. Original document provided by applicant with Feb. 5, 2013 IDS).*
(Continued)

*Primary Examiner* — Paul A Wartalowicz
*Assistant Examiner* — Stephani Hill
(74) *Attorney, Agent, or Firm* — Clark & Brody

(57) ABSTRACT

A high-strength steel sheet has a chemical composition comprising C: 0.05-0.20%, Si: 0.02-3.0%, Mn: 0.5-3.0%, P: at most 0.5%, S: at most 0.05%, Cr: 0.05-1.0%, sol. Al: 0.01-1.0%, one or more elements selected from the group consisting of Ti, Nb, Mo, V, and W: a total of 0.002-0.03%, and a remainder of Fe and impurities. The sheet has an average grain diameter of ferrite of at most 3.0 μm at least in a region of 100-200 μm in the sheet thickness direction from the surface of the steel sheet. The average spacing in the sheet thickness direction of the remaining structure in this region is at most 3.0 μm. Mechanical properties include at least 750 MPa tensile strength and at least 13,000 MPa·% (tensile strength×elongation).

3 Claims, 1 Drawing Sheet

(51) Int. Cl.

| | |
|---|---|
| ***C22C 38/06*** | (2006.01) |
| ***C22C 38/28*** | (2006.01) |
| ***C22C 38/38*** | (2006.01) |
| ***C22C 38/22*** | (2006.01) |
| ***C22C 38/24*** | (2006.01) |
| ***C22C 38/26*** | (2006.01) |
| ***C21D 8/02*** | (2006.01) |

(52) U.S. Cl.
CPC ..... *C22C 38/005* (2013.01); *C22C 38/02* (2013.01); *C22C 38/06* (2013.01); *C22C 38/22* (2013.01); *C22C 38/24* (2013.01); *C22C 38/26* (2013.01); *C22C 38/28* (2013.01); *C22C 38/38* (2013.01)

(58) Field of Classification Search
CPC ..... C22C 38/005; C22C 38/26; C22C 38/24; C22C 38/06; C22D 8/0263
USPC ..... 148/331; 420/83, 105
See application file for complete search history.

(56) References Cited

U.S. PATENT DOCUMENTS

| | | | | |
|---|---|---|---|---|
| 7,371,294 | B2 * | 5/2008 | Miura et al. | 148/333 |
| 2001/0004910 | A1 * | 6/2001 | Yasuhara et al. | 148/546 |
| 2001/0050119 | A1 * | 12/2001 | Inoue et al. | 148/544 |
| 2002/0115011 | A1 * | 8/2002 | Komoto et al. | 430/125 |
| 2004/0074575 | A1 * | 4/2004 | Kashima et al. | 148/653 |
| 2008/0131305 | A1 | 6/2008 | Okitsu | |
| 2008/0202639 | A1 | 8/2008 | Tomida et al. | |
| 2009/0317654 | A1 * | 12/2009 | Saruwatari et al. | 428/600 |
| 2012/0118438 | A1 * | 5/2012 | Nakagaito | C21D 8/0226 148/533 |

FOREIGN PATENT DOCUMENTS

| | | | | |
|---|---|---|---|---|
| JP | 2001140035 | A * | 5/2001 | C22C 38/00 |
| JP | 2001220648 | A * | 8/2001 | |
| JP | 2002-285278 | | 10/2002 | |
| JP | 3458416 | | 8/2003 | |
| JP | 2004-285435 | | 10/2004 | |
| JP | 2005002385 | A * | 1/2005 | |
| JP | 2007211334 | A * | 8/2007 | |
| JP | 2008-189984 | | 8/2008 | |
| JP | 2008-231480 | | 10/2008 | |
| JP | 2008-255442 | | 10/2008 | |
| JP | 2009-102715 | | 5/2009 | |
| JP | 2009242816 | A * | 10/2009 | C22C 38/00 |
| JP | 2012001773 | A * | 1/2012 | |
| WO | WO-2010146796 | A1 * | 12/2010 | C21D 8/0226 |

OTHER PUBLICATIONS

JP2001-140035 machine translation.*
Temper Rolling. The Free Dictionary by Farlex. http://encyclopedia2.thefreedictionary.com/Temper+Rolling. Accessed Jul. 7, 2016.*
Dossett, Jon L. Totten, George E. (2013). ASM Handbook, vol. 04A—Steel heat Treating Fundamentals and Processes. ASM International.*
JP 2009-242816 machine translation.*
JP 2007-211334 machine translation (Year: 2007).*
JP 2001-220648 machine translation (Year: 2001).*
JP 2005-002385 machine translation (Year: 2005).*
JP H05-148579 machine translation (Year: 1993).*
JP 2012-001773 (Year: 2012).*
Yoshitaka Okitsu et al., "Cho Bisairyu . . . Akkai Tokusei", Current advances in materials and processes, vol, 20, No. 6, Sep. 1, 2007, p. 1390.
Tsuji et al., "Toughness of Ultrafine Grained Ferritic Steels Fabricated by ARB and Annealing Process", Materials Transactions, vol. 45, No. 7, 2004, pp. 2272-2281.
Mariene Gasdia-Cochrane, "Adjusting Rolling Speed and Thickness to Help Ensure Metal Strip Quality", Aug. 5, 2018, XP055537612, retrieved from the internet: URL: https//www.thermofisher.com/blog/metals/adjusting-to-rolling-speed-and-thickness-to-help-ensure-metal-strip-quality/.

* cited by examiner

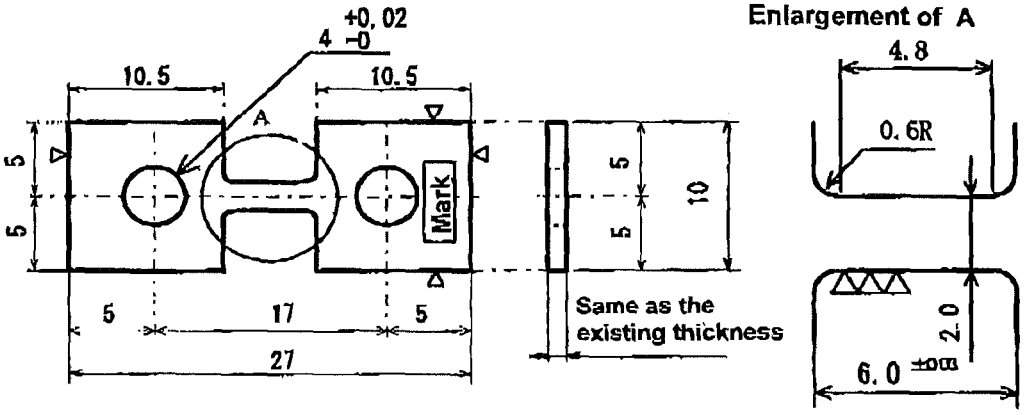
+0.02
4 -0
10.5
10.5
A
5
5
Mark
5
17
5
27
5
5
10
Same as the existing thickness
Enlargement of A
4.8
0.6R
2.0
6.0 ±0.3

STEEL SHEET AND A METHOD FOR ITS MANUFACTURE

TECHNICAL FIELD

This invention relates to a steel sheet having a tensile strength of at least 750 MPa as well as excellent press formability and dynamic deformation properties and to a method for its manufacture.

BACKGROUND ART

In order to promote a decrease in the weight of automobiles and increase the safety in collisions of automobiles, high tensile strength steel sheets are widely used as a material for members which bear a load at the time of an impact (referred to below as impact-resisting members) which are among the components of automobile bodies. In general, the strength of a steel sheet is influenced by the rate of deformation. As the strain rate of a steel sheet at the time of deformation increases, the deforming stress of the steel sheet increases. A steel sheet having a significantly high tensile strength at the time of a high rate of deformation is suitable as a material for impact-resisting members.

Patent Document 1 discloses a cold-rolled steel sheet with improved impact resistance having a dual-phase structure of ferrite and 10-50% by volume of martensite. This cold-rolled steel sheet is improved in the dynamic deformation properties (the difference between the tensile strength at a high tensile strain rate and the tensile strength at a low tensile strain rate) by reducing the content of solid solution elements dissolved in the ferrite. As a result, it has an increased yield strength when undergoing a high strain rate tensile deformation. Although not specified in Patent Document 1, the tensile strength of a steel sheet having the chemical composition and properties disclosed in Patent Document 1 is thought to be around 590 MPa.

Patent Document 2 discloses a method of manufacturing a high-strength steel sheet which has an ultrafine structure and excellent dynamic deformation properties and which has ferrite grains refined to such an extent that they have a size on the order of nanometers by repeatedly carrying out rolling on a plurality of steel sheets which are stacked. However, because this method requires performing rolling a plurality of times on a plurality of stacked steel sheets, its productivity is extremely poor.

Patent Document 3 discloses a method of manufacturing a cold-rolled annealed sheet having an ultrafine ferritic structure by carrying out cold rolling with an overall rolling reduction of at least 20% and less than 80% on a hot-rolled steel sheet containing at least 90% of a martensitic phase followed by low-temperature annealing at 500-600° C. However, because this method uses a hot-rolled steel sheet having a martensitic phase as a material for working, the material being rolled takes on a high strength and is hardened during cold rolling, and cold rollability markedly worsens, leading to a low productivity.

As disclosed in Non-Patent Document 1, it is known that uniform elongation of a steel sheet markedly decreases as grains are refined.

PRIOR ART DOCUMENTS

Patent Documents

Patent Document 1: JP 3 458 416 B
Patent Document 2: JP 2000-73152 A
Patent Document 3: JP 2002-285278 A

Non-Patent Documents

Non-Patent Document 1: Mater. Trans., 45 (2004), No. 7, pp. 2272-2281

DISCLOSURE OF INVENTION

The prior art cannot provide a steel sheet having a tensile strength of at least 750 MPa as well as excellent press formability and excellent dynamic deformation properties.

According to the present invention, a steel sheet having a tensile strength of at least 750 MPa as well as excellent press formability and excellent dynamic deformation properties is provided by making the main phase of the metallographic structure of the steel sheet a fine ferritic structure and by suitably controlling the type and dispersed state of a second phase. Specifically, (a) the dynamic deformation properties of a steel sheet are improved by suppressing precipitation of strengthening elements contained in the steel sheet, refining ferrite grains, and uniformly and finely dispersing a second phase, and (b) the effect described above in (a) is obtained not only with respect to a steel sheet which has undergone hot rolling but also with respect to a steel sheet which has undergone cold rolling and annealing after hot rolling.

The present invention is a steel sheet characterized by having the below-described chemical composition and metallographic structure.

Chemical composition: It consists essentially of C: 0.05-0.20% (in this description, unless otherwise specified, percent with respect to chemical composition means mass percent), Si: 0.02-3.0%, Mn: 0.5-3.0%, P: at most 0.5%, S: at most 0.05%, Cr: 0.05-1.0%, sol. Al: 0.01-1.0%, one or more elements selected from the group consisting of Ti, Nb, Mo, V, and W: a total of 0.002-0.03%, if necessary one or more of Ca, Mg, and REM: a total of at most 0.0050%, and a remainder of Fe and impurities.

Metallographic structure: The average grain diameter of ferrite is at most 3.0 μm at least in a region of from 100 to 200 μm in the sheet thickness direction from the surface of the steel sheet, this region consists essentially of 30-80% by area of ferrite and remaining structure, and the average spacing in the sheet thickness direction of the remaining structure in this region is at most 3.0 μm.

From another standpoint, the present invention is a method of manufacturing a steel sheet having mechanical properties in which the tensile strength is at least 750 MPa, the product of the tensile strength and the elongation at rupture is at least 13,000 MPa·%, and the difference between the dynamic tensile strength at a tensile strain rate of $10^3$ $sec^{-1}$ and the static tensile strength at a tensile strain rate of 0.01 $sec^{-1}$ is at least 80 MPa by performing hot rolling with multiple passes of a steel billet having the above-described chemical composition followed by cooling and coiling, characterized in that the hot rolling, cooling, and coiling are carried out under conditions satisfying the following Conditions 1-4.

Condition 1: The rolling temperature in the final rolling pass of finish rolling in the hot rolling is at least the $Ar_3$ point.

Condition 2: The total of the time for three consecutive passes including the final rolling pass and the cooling time from the temperature at the completion of the finish rolling down to 720° C. is at most 4.0 seconds.

Condition 3: The cooling starts within 0.5 seconds of the completion of the finish rolling.

Condition 4: The coiling is carried out at a temperature of at most 630° C.

In a manufacturing method according to the present invention, after carrying out coiling, cold rolling may be carried out with a rolling reduction of 40-80% followed by annealing by holding for 10-300 seconds in a temperature range from $Ac_1$ to ($Ac_3$+10° C.).

A steel sheet according to the present invention and a steel sheet manufactured by a method according to the present invention have the following mechanical properties.

Mechanical properties: The tensile strength is at least 750 MPa, the product of the tensile strength and the elongation at rupture is at least 13,000 MPa·%, and the difference between the dynamic tensile strength measured at a tensile strain rate of $10^3$ $sec^{-1}$ and the static tensile strength measured at a tensile strain rate of 0.01 $sec^{-1}$ is at most 80 MPa.

According to the present invention, a steel sheet having a tensile strength of at least 750 MPa as well as excellent press formability and excellent dynamic deformation properties is provided without worsening productivity.

BRIEF EXPLANATION OF THE DRAWINGS

FIG. 1 is an explanatory view showing the shape of a test piece for a high strain rate tensile test.

MODES FOR CARRYING OUT THE INVENTION

1. Chemical Composition

[C: 0.05-0.20%]

C lowers the transformation temperature from austenite to ferrite and lowers the finishing temperature in hot rolling, and hence it effectively promotes refining of ferrite grains. In addition, C guarantees the strength of steel. Therefore, the C content is at least 0.05%. In order to promote greater refinement of ferrite grains, the C content is preferably at least 0.08%. However, if the C content exceeds 0.20%, a ferrite transformation after hot rolling is delayed, thereby decreasing the volume percentage of ferrite, and weldability deteriorates. Therefore, the C content is at most 0.20%, and it is preferably at most 0.17% in order to increase the workability of welds.

[Si: 0.02-3.0%]

Si increases the strength of a steel sheet. Therefore, the Si content is at least 0.02%, preferably at least 0.1%, and more preferably at least 0.3%. However, if the Si content exceeds 3.0%, the ductility of a steel sheet markedly deteriorates, and surface oxidation of a material being rolled takes place during hot rolling. Therefore, the Si content is made at most 3.0%, preferably at most 2.0%, and more preferably at most 1.8%. When forming retained austenite in a ferritic structure, the total content of Si and sol. Al is preferably at least 1.0%.

[Mn: 0.5-3.0%]

Mn guarantees the strength of a steel sheet. Furthermore, Mn lowers both the transformation temperature from austenite to ferrite and the finishing temperature for hot rolling, thereby promoting refinement of ferrite grains. Therefore, the Mn content is at least 0.5%, preferably at least 1.0%, and more preferably at least 1.5%. However, if the Mn content exceeds 3.0%, ferrite transformation after hot rolling is delayed, thereby decreasing the volume percentage of ferrite. Therefore, the Mn content is made at most 3.0% and preferably at most 2.5%.

[P: at Most 0.5%]

P is contained as an unavoidable impurity. If the P content exceeds 0.5%, P segregates at grain boundaries and the stretch flanging properties of steel sheets deteriorate. Therefore, the P content is at most 0.5%, preferably at most 0.2%, and more preferably at most 0.05%.

[S: at Most 0.05%]

S is contained as an unavoidable impurity. If the S content exceeds 0.05%, sulfide inclusions are formed and the workability of a steel sheet decreases.

The lower is the S content, the better is the workability of a steel sheet. Therefore, the S content is at most 0.05%, preferably at most 0.008%, and more preferably at most 0.003%.

[Cr: 0.05-1.0%]

Cr strengthens ferrite. In addition, it increases the hardenability of a steel sheet and forms martensite and bainite in ferrite. Furthermore, Cr suppresses the formation of coarse pearlite and contributes to form a finely dispersed structure, thereby increasing the dynamic strength. Therefore, the Cr content is at least 0.05% and more preferably at least 0.1%. However, if the Cr content exceeds 1.0%, the surface condition and ductility of a steel sheet deteriorate. Therefore, the Cr content is at most 1.0% and preferably at most 0.8%.

[Sol. Al: 0.01-1.0%]

Al increases the ductility of a steel sheet. Therefore, the sol. Al content is at least 0.01%. However, if the sol. Al content exceeds 1.0%, austenite becomes unstable at high temperatures. As a result, it becomes necessary to excessively increase the finishing temperature in hot rolling, and it is no longer possible to stably carry out continuous casting. Therefore, the sol. Al content is at most 1.0% and preferably at most 0.5%.

When forming retained austenite in a ferritic structure, the total content of Si and sol. Al is preferably at least 1.0%.

[One or More Elements Selected from the Group Consisting of Ti, Nb, Mo, V, and W: a Total of 0.002-0.03%]

Each of Ti, Nb, Mo, V, and W is effective at suppressing coarsening of grains or refining grains due to the formation of carbonitrides and for some elements due to the presence in steel in the form of a solid solution. Therefore, one or more of Ti, Nb, Mo, V, and W are contained in a total of at least 0.002%. However, if the total content of one or more elements of Ti, Nb, Mo, V, and W exceeds 0.03%, mobile dislocations easily develop in ferrite and the dynamic deformation properties of a steel sheet worsen. Therefore, the total content of one or more elements selected from the group consisting of Ti, Nb, Mo, V, and W is at most 0.03%.

[One or More of Ca, Mg, and REM: a Total of at Most 0.0050%]

Ca, Mg, and rare earth elements (REM) maintain the soundness of a steel casting by refining oxides and carbides which precipitate at the time of solidification of a steel casting, so they may be added as necessary as optional elements. If the total content of one or more of these elements exceeds 0.0050%, inclusions are formed so that the formability of a steel sheet deteriorates, and the manufacturing costs of a steel sheet increase. Therefore, the total content of one or more of these elements is at most 0.0050%. In order to obtain the above-described effects with certainty, the total content of one or more of these elements is preferably at least 0.0005%.

The remainder other than the above elements is Fe and impurities. An example of impurities other than the above-described elements is N. N is present as an unavoidable impurity. If the N content exceeds 0.01%, the workability of a steel sheet decreases. Therefore, the N content is preferably at most 0.01% and more preferably at most 0.006%.

2. Metallographic Structure

The absorption of impact energy by an impact-resisting member of an automobile often takes place by locally producing bending deformation in a plurality of locations of an impact-resisting member which typically has a hat-shaped or similar polygonal shaped closed cross section when an external load is applied to the member in the axial direction or in the transverse direction. Accordingly, the mechanical properties in the vicinity of the surface in the sheet thickness direction of a steel sheet which is a material for forming an impact-resisting member are important in order for the impact-resisting member to exhibit improved energy-absorbing properties.

In general, in the manufacture of a steel sheet, decarburization and concentration of easily oxidizable elements take place in the outermost layer in the sheet thickness direction of a steel sheet due to the influences of the atmosphere in the heating furnace and the coiling temperature of a hot-rolled steel sheet. As a result, the structure and the mechanical properties of the outermost layer of a steel sheet easily vary with location in the thickness direction of the steel sheet. In contrast, the structure and mechanical properties at a location which is at a minute distance in the sheet thickness direction from the outermost layer of a steel sheet (100-200 μm) are stable.

As a result of diligent investigation of the influence of various factors in a region of 100-200 μm in the sheet thickness direction from the surface of a steel sheet on the mechanical properties of a steel sheet, the present inventors found that the factors explained below are important. These factors will be explained.

[Average Grain Diameter of Ferrite at Least in a Region of 100-200 μm in the Sheet Thickness Direction from the Surface of a Steel Sheet: at Most 3.0 μm]

It is necessary for the average grain diameter of ferrite at least in a region of 100-200 μm in the sheet thickness direction from the surface of a steel sheet to be at most 3.0 μm in order to provide a steel sheet (including not only a hot-rolled steel sheet but also a cold-rolled steel sheet which has undergone cold rolling and annealing) with adequate dynamic deformation properties. This average grain diameter is preferably at most 2.5 μM, more preferably at most 2.0 μm, and most preferably at most 1.5 μm.

The average grain diameter of ferrite is preferably as small as possible. However, it is difficult to make the average grain diameter of ferrite less than 0.3 μm using existing manufacturing processes for a steel sheet. Accordingly, the average grain diameter of ferrite is preferably at least 0.3 μm. Taking into consideration productivity, it is more preferably at least 0.5 μm.

[Area Fractions in the Structure at Least in a Region of 100-200 μm in the Sheet Thickness Direction from the Surface of a Steel Sheet: 30-80% of Ferrite and Remaining Structure]

If the area fraction of ferrite in the above-described region of a steel sheet is less than 30%, the steel sheet does not have adequate dynamic deformation properties. On the other hand, if this area fraction exceeds 80%, although the dynamic deformation properties of the steel sheet are further improved, the static tensile strength of the steel sheet worsens. Therefore, the area fraction of ferrite in this region is made 30-80%. This area fraction is preferably at least 40% and more preferably at least 50%. This area fraction is preferably at most 75% and more preferably at most 70%.

[Average Spacing in the Sheet Thickness Direction of the Remaining Structure at Least in a Region of 100-200 μm in the Sheet Thickness Direction from the Surface of the Steel Sheet: at Most 3.0 μm]

The average spacing in the sheet thickness direction of the remaining structure other than ferrite in the above-described region is at most 3.0 μm. This average spacing in the sheet thickness direction is preferably at most 2.5 μm, more preferably at most 2.0 μm, and most preferably at most 1.6 μm.

There is no particular limitation on the type of the remaining structure, and depending upon the static tensile strength demanded of the steel sheet, it can be, for example, bainite, martensite, retained austenite, granular cementite, or the like. The remaining structure is preferably bainite, tempered martensite, bainite and tempered martensite, or granular cementite.

The average spacing in the sheet thickness direction is determined by subjecting a cross section in the rolling direction of the steel sheet to mirror polishing and then nital etching, then obtaining a digital image of a region of 100-200 μm from the surface layer at a magnification of 1,000-2,000× using a scanning electron microscope, drawing a line on the digital image with a length of 40-80 μm in the sheet thickness direction, measuring the spacing of the remaining structure in the sheet thickness direction at 5 arbitrary locations, and taking the average of these measurements.

When the average grain diameter of ferrite in the above-described region is at most 3.0 μm and the area fraction of ferrite in this region is 30-80%, if the average spacing in the sheet thickness direction of the remaining structure other than ferrite exceeds 3.0 μm, the remaining structure exists locally and in the form of bands, indicating that the remaining structure which is a secondary phase is no longer uniformly and finely dispersed. As a result, the press formability and the dynamic strength of the steel sheet decrease.

Furthermore, if the remaining structure of the steel sheet is present locally in the form of bands, the remaining structure of a cold-rolled annealed steel sheet manufactured by carrying out cold rolling and annealing of this steel sheet will be in the form of bands, and the dynamic strength of the cold-rolled annealed steel sheet will be inadequate.

For the above reasons, the average spacing in the sheet thickness direction of the remaining structure other than ferrite in a region of 100-200 μm in the sheet thickness direction from the surface of the steel sheet is at most 3.0 μm, preferably at most 2.5 μm, more preferably at most 2.0 μm, and most preferably at most 1.6

In light of the average ferrite grain diameter which is effective to improve dynamic deformation properties, the lower limit on the average spacing in the sheet thickness direction of the remaining structure is preferably at least 0.3 μm and more preferably at least 0.5 μm.

The average spacing in the rolling direction of the remaining structure in a region of 100-200 μm in the sheet thickness direction from the surface of the steel sheet is preferably at most 3.0 μm. As a result, the degree of flatness (aspect ratio) of the ferritic structure which forms the mother phase of the steel sheet decreases, indicating that more isodiametric ferrite grains exist in a finely dispersed form. Accordingly, more uniform strains are imparted to ferrite not only at the time of static deformation but also at the time of dynamic deformation, and as a result, static elongation and dynamic strength are increased. The average spacing in the rolling direction of the remaining structure in this region is preferably at most 2.5 μm, more preferably at most 2.0 μm, and most preferably at most 1.6 μm.

When the remaining structure includes retained austenite, if the area fraction of retained austenite is 5-30%, the press formability of a steel sheet after completion of hot rolling is markedly improved. If the area fraction of retained austenite is less than 5%, press formability is not adequately increased, while if the area fraction of retained austenite exceeds 30%, the unstable nature of austenite abridges the effect of increasing press formability. Therefore, in order to improve the press formability of a steel sheet, the area fraction of retained austenite in the remaining structure is preferably 5-30%.

3. Mechanical Properties

[Tensile Strength: at Least 750 MPa]

The tensile strength is at least 750 MPa. Tensile strength is measured by preparing a JIS No. 5 tensile test piece and carrying out a tensile test thereon.

[Product of Tensile Strength and Elongation at Rupture: at Least 13,000 MPa·%]

The product of tensile strength and elongation at rupture is at least 13,000 MPa·%. By making the product this value, excellent press formability is obtained. When an impact-resisting member has a complicated shape, it is preferable that the product of tensile strength and elongation at rupture be at least 14,000 MPa·%. When a higher degree of press formability is desired for reasons such as integrally forming an impact-resisting member with other structural members, the product of tensile strength and elongation at rupture is preferably at least 16,000 MPa·% and more preferably at least 17,000 MPa·%.

[Difference Between the Dynamic Tensile Strength at a Tensile Strain Rate of $10^3$ $Sec^{-1}$ and the Static Tensile Strength at a Tensile Strain Rate of 0.01 $sec^1$: at Least 80 MPa]

FIG. 1 is an explanatory diagram showing the shape of a test piece for a high strain rate tensile test. This strength difference is defined as the difference ΔTS between the dynamic tensile strength measured at a tensile strain rate of $10^3$ $sec^{-1}$ and the static tensile strength measured at a tensile strain rate of 0.01 $sec^{-1}$ using a stress sensing block-type high strain rate tensile testing apparatus on a minute test piece having the shape shown in FIG. 1. Having excellent dynamic deformation properties means that the strength difference ΔTS is at least 80 MPa, preferably at least 100 MPa, and most preferably at least 120 MPa.

4. Manufacturing Method

[Hot Rolling Step]

A steel billet having the above-described chemical composition is hot rolled for a plurality of passes. The rolling temperature of the final rolling pass in finish rolling in the hot rolling step is at least the $Ar_3$ point.

Hot rolling is carried out in an austenite temperature range preferably from a temperature exceeding 1,000° C. using a reversing mill or a tandem mill. From the standpoint of industrial productivity, at least the final few stages of rolling are preferably carried out using a tandem mill.

The billet may be a slab obtained by continuous casting or by casting and blooming, a steel sheet obtained by strip casting, one of these members which if necessary has previously undergone hot working or cold working, or the like. When the temperature of the billet is low, hot rolling is started after the billet has been reheated to a temperature exceeding 1,000° C.

If the starting temperature of hot rolling is 1,000° C. or less, not only does the rolling load become excessive and it becomes difficult to obtain an adequate rolling reduction, but it also becomes impossible to finish hot rolling with an adequate rolling reduction at a temperature of at least the $Ar_3$ point. As a result, desired mechanical properties and thermal stability can no longer be obtained.

The starting temperature for hot rolling is more preferably at least 1025° C. and still more preferably at least 1050° C. In order to suppress coarsening of austenite grains and restrain equipment costs and heating fuel costs, the starting temperature for hot rolling is preferably at most 1350° C. and more preferably at most 1280° C.

In the case of a steel type for which it is unnecessary to adequately dissolve precipitates such as TiC or NbC in austenite, the starting temperature for hot rolling is preferably a relatively low temperature in this temperature range (such as 1050-1250° C.). As a result, the initial austenite grain diameter is refined, and it becomes easier to refine the ferrite grains in the resulting steel sheet.

The finishing temperature for hot rolling is made at least the $Ar_3$ point in order to transform austenite into ferrite after hot rolling. From the standpoint of avoiding an increase in the rolling load, the finishing temperature is preferably at least 780° C.

The temperature at the completion of hot rolling, namely, the rolling temperature on the exit side of the final rolling pass in finish rolling in the hot rolling step is at least the $Ar_3$ point, but it is preferably as low a temperature as possible. This is because the lower the temperature at the completion of hot rolling, the greater the effect of accumulating residual strains by working which are introduced into austenite by hot rolling, and refinement of ferrite grains is promoted. The $Ar_3$ point of steels used in the present invention is generally from 730° C. to 950° C.

Hot rolling is carried out in a plurality of successive passes. The rolling reduction per pass is preferably 15-60%. Having a large rolling reduction per pass accumulates more strains in austenite and refines ferrite grains which are produced by transformation. Therefore, particularly in three consecutive passes including the final rolling pass of finish rolling in hot rolling, the rolling reduction per pass is preferably at least 20%.

In the above-mentioned three passes, the rolling reduction per pass is preferably less than 50% in order to avoid increases in the size of rolling equipment due to an increase in the rolling load and to guarantee the controllability of the shape of a steel sheet. In particular, in order to make it easy to control the shape of a steel sheet, the rolling reduction in each of these passes is preferably at most 40% per pass.

[Cooling Step]

After the completion of hot rolling, the resulting steel sheet is cooled. As a result of this cooling, without releasing the deformation bands (residual strains by working) which were introduced into austenite, austenite is transformed into ferrite using the deformation bands as nucleation sites for ferrite. The resulting steel sheet has a metallographic structure in which fine ferrite and the remaining structure are uniformly dispersed.

In order to obtain this metallographic structure, hot rolling is carried out so that the total of the rolling time for the above-described three passes and the cooling time from the temperature at the completion of finish rolling to 720° C. is at most 4.0 seconds, and cooling is started within 0.5 seconds of the completion of finish rolling.

The total of the rolling time and the cooling time to 720° C. can be determined by measuring with a sensor the timing when the front end of a steel sheet reaches the first roll of the three passes, measuring the temperature of the steel sheet with temperature sensors installed in a cooling zone, and then calculating the total time from the relationship between these measured values and the speed of travel of the steel sheet. The time from the completion of finish rolling until the start of cooling can be calculated from the speed of travel of the steel sheet and the distance between the final roll and the cooling zone.

The above-mentioned time for three passes affects the proportion of elimination of the deformation bands, namely, the nucleation sites which have been introduced by hot rolling. The cooling time also affects the proportion of elimination of deformation bands during cooling. Therefore, hot rolling and subsequent cooling are carried out such that the above-described total time is at most 4.0 seconds in order to adequately maintain the deformation bands which were introduced by hot rolling.

The reason for controlling the time for the final three passes is as follows. Since these passes are rolling passes performed in the vicinity of the lower limit of the recrystallization temperature, no recrystallization of austenite occurs during these passes. In addition, since hot rolling is carried out at approximately a constant temperature of 800-950° C. due to the working heat, the rolling time becomes a main factor in retaining the deformation bands.

Furthermore, the cooling time also affects the proportion of the deformation bands which disappear, namely, the formation of fine ferrite grains. Therefore, cooling is started as soon as possible after finish rolling is completed and specifically within 0.5 seconds of the completion of finish rolling. Cooling is preferably started within 0.3 seconds, more preferably within 0.1 seconds, and most preferably within 0.05 seconds of the completion of finish rolling.

A temperature range of 720° C. or below is a transformation temperature range in which transformation from austenite to ferrite becomes active. A temperature range for ferrite transformation in which the desired fine ferritic structure is obtained is 720-600° C. Therefore, a steel sheet can be maintained in a temperature range of 720-600° C. for 1-10 seconds by temporarily stopping cooling or by lowering the cooling rate after the temperature of a steel sheet reaches 720° C. or below.

[Coiling Step]

A steel sheet which has undergone the hot rolling step and the cooling step is coiled in a coiling step at 630° C. or below. As a result, the remaining structure of the steel sheet other than ferrite is controlled.

If the coiling temperature exceeds 630° C., a large amount of pearlite is formed. As a result, the elongation of a steel sheet decreases and a static tensile strength of at least 750 MPa is not guaranteed.

When the remaining structure is made martensite, it is preferable to perform cooling in a temperature range of 600° C. or below at a cooling rate of at least 40° C. per second and carry out coiling in a temperature range from room temperature to at most 200° C. If the coiling temperature exceeds 200° C., the desired strength of a steel sheet may not be obtained due to tempering of martensite, and the balance between strength and ductility worsens. When there is concern of formation of rust on a steel sheet due to cooling water remaining on the sheet, the coiling temperature is more preferably made 100-150° C.

When the remaining structure is made bainite, coiling is preferably carried out at a temperature of at least 400° C. to less than 600° C. When the remaining structure is made so as to contain both bainite and retained austenite, coiling is more preferably carried out at a temperature of 400-450° C.

When the remaining structure is made granular cementite, coiling is preferably carried out at a temperature of at least 600° C. to at most 630° C. In order to produce greater refinement of the remaining structure, the coiling temperature is more preferably made at most 620° C.

[Cold Rolling Step]

A steel sheet which has passed through the coiling step may be further subjected to cold rolling and annealing. In this case, before carrying out cold rolling, scale on the surface of the steel sheet may be removed by pickling.

Cold rolling is carried out with a rolling reduction of 40-80%. The rolling reduction is defined as {(steel sheet thickness before cold rolling-steel sheet thickness after cold rolling)/steel sheet thickness before cold rolling)}×100%.

If the rolling reduction is less than 40%, sufficient strains are not imparted to ferrite, and the static elongation of the steel sheet after annealing decreases. The rolling reduction is preferably at least 50%. However, if the rolling reduction is a high level exceeding 80%, a large load is imparted to the rolling mill, and the productivity of a steel sheet decreases.

In order to efficiently impart strains to ferrite, it is preferred that the remaining structure other than ferrite of a steel sheet which is subjected to cold rolling after the above-described hot rolling and cooling be a structure which includes martensite or bainite. For example, the remaining structure of the steel sheet can be made a structure including martensite or bainite by coiling in a temperature range from room temperature to at most 200° C. after cooling in a temperature range below 600° C. at a cooling rate of at least 40° C. per second or by coiling in a temperature range of at least 400° C. to less than 600° C.

[Annealing Step]

A high-strength steel sheet having a high dynamic tensile strength is obtained by subjecting a steel sheet having a structure in which strain energy has been accumulated by cold rolling to annealing, namely, by heating and holding the steel sheet at a fixed temperature followed by cooling.

The holding temperature is made between $Ac_1$ to ($Ac_3$+10° C.) of the steel sheet. If the holding temperature is lower than $Ac_1$, the second phase which by nature should contribute to static tensile strength becomes cementite alone, and sufficient static tensile strength is not obtained. Furthermore, even if a sufficient static tensile strength is obtained, recovery to a normal structure and recrystallization sometimes do not adequately progress, the static tensile elongation decreases, and the dynamic tensile strength decreases due to the presence of residual strains by working which remains in ferrite. The lower limit on the holding temperature is preferably 750° C. from the standpoint of productivity.

On the other hand, if the holding temperature exceeds ($Ac_3$+10° C.), austenite coarsens, and ferrite which precipitates in the subsequent cooling step also coarsens, so both the static tensile strength and the dynamic tensile strength decrease. The upper limit on the holding temperature is preferably the $Ac_3$ temperature.

The holding time is 10-300 seconds. If the holding time is less than 10 seconds, it is difficult to carry out holding in an existing manufacturing process, and the metallographic structure easily becomes band-shaped due to segregation of substitutional elements. Furthermore, in cases in which the holding temperature is a relatively low temperature within the above-described range, it becomes difficult to remove residual strains which are imparted by working during cold rolling, leading to a decrease in the elongation of a steel sheet. On the other hand, if the holding time exceeds 300 seconds, austenite coarsens during holding, and ferrite grains which precipitate in the subsequent cooling step also coarsen, resulting in a decrease in both static tensile strength and dynamic tensile strength.

Cooling after holding influences the metallographic structure of a steel sheet. By cooling to the Ms point or below without intersecting the bainite nose in a CCT diagram, the remaining structure other than ferrite becomes martensite. If the bainite nose is intersected during cooling or if cooling is stopped in the bainite region, the remaining structure becomes bainite. If the cooling rate is low, elongation of the steel sheet decreases due to precipitation of pearlite. Therefore, the cooling rate in a range of 700° C. or below is preferably at least 20° C. per second.

In this manner, a steel sheet is manufactured which has the mechanical properties that its tensile strength is at least 750 MPa, the product of the tensile strength and the elongation at rupture is at least 13,000 MPa·%, and the difference between the dynamic tensile strength and the static tensile strength is at least 80 MPa.

Example 1

A hot-rolled steel sheet was manufactured from steel billets having chemical compositions A-L shown in Table 1 under the conditions shown in Table 2. Chemical compositions F-I in Table 1 are ones which do not satisfy the chemical composition defined by the present invention, and Runs Nos. 13 and 14 in Table 2 do not satisfy the manufacturing conditions defined by the present invention. Columns F1-F3 in Table 2 indicate the rolling reduction in each stand, Δt indicates the elapsed time from the completion of finish rolling until the start of cooling, and (time from F1 to 720° C.) indicates the total of the time for three consecutive passes F1-F3 including the final rolling pass and the cooling time from the temperature at the completion of finish rolling to 720° C.

TABLE 1

| Steel | C | Si | Mn | Cr | P | S | sol. Al | Ti | Nb | V | Mo | W | N | Others | $Ar_3$ | $Ac_3$ | $Ac_1$ |
|---|---|---|---|---|---|---|---|---|---|---|---|---|---|---|---|---|---|
| A | 0.15 | 0.5 | 2.0 | 0.25 | 0.002 | 0.002 | 0.030 | 0.01 | 0.008 | | | | 0.0025 | | 741 | 831 | 733 |
| B | 0.16 | 1.0 | 2.0 | 0.25 | 0.002 | 0.002 | 0.500 | 0.01 | | | | | 0.0025 | | 833 | 930 | 663 |
| C | 0.15 | 0.5 | 2.6 | 0.25 | 0.002 | 0.002 | 0.030 | 0.01 | | | | | 0.0032 | | 724 | 812 | 726 |
| D | 0.15 | 0.51 | 2.01 | 0.50 | 0.001 | 0.0028 | 0.029 | 0.01 | | | | | 0.0041 | | 739 | 828 | 739 |
| E | 0.13 | 1.0 | 2.5 | 0.05 | 0.008 | 0.004 | 0.032 | | 0.01 | | | | 0.0032 | | 752 | 843 | 732 |
| F | 0.14 | 0.5 | 1.99 | 0.26 | 0.002 | 0.003 | 0.033 | 0.05 | | | | | 0.0031 | | 749 | 839 | 733 |
| G | 0.025 | 1.01 | 2.46 | 0.01 | 0.005 | 0.001 | 0.190 | | 0.01 | | | | 0.0035 | | 818 | 919 | 707 |
| H | 0.23 | 0.5 | 1.96 | 0.25 | 0.001 | 0.0027 | 0.031 | 0.01 | | | | | 0.0036 | | 719 | 807 | 732 |
| I | 0.10 | 0.5 | 3.2 | 0.05 | 0.005 | 0.001 | 0.030 | 0.01 | | | | | 0.0035 | | 714 | 801 | 715 |
| J | 0.15 | 0.5 | 2.0 | 0.20 | 0.002 | 0.001 | 0.035 | 0.01 | | | 0.01 | | 0.0028 | Mg: 20 ppm | 744 | 833 | 731 |
| K | 0.14 | 0.5 | 2.0 | 0.18 | 0.003 | 0.001 | 0.029 | 0.01 | | 0.01 | | | 0.0030 | Ca: 20 ppm | 747 | 837 | 732 |
| L | 0.16 | 0.5 | 2.0 | 0.25 | 0.005 | 0.001 | 0.033 | 0.01 | | | | 0.01 | 0.0045 | REM: 10 ppm | 736 | 825 | 733 |

(Note) remainder: Fe and impurities

TABLE 2

| Run No. | Steel | $Ar_3$ | Heating temp. (° C.) | F1 | F2 | F3 | Finish rolling temp. | Δt (sec) | Cooling rate (° C./sec) | Time from F1 to 720° C. (sec) | Temp. at stop of cooling (° C.) | Duration of air cooling (sec) | Scondary cooling rate (° C./sec) | Coiling temp. (° C.) | Remark |
|---|---|---|---|---|---|---|---|---|---|---|---|---|---|---|---|
| 1 | A | 741 | 1250 | 29% | 29% | 31% | 830 | 0.043 | >1000 | 2.44 | 678 | 3.5 | 72 | 400 | Inventive |
| 2 | B | 833 | 1250 | 29% | 29% | 31% | 885 | 0.043 | >1000 | 2.56 | 681 | 3.5 | 75 | 400 | Inventive |
| 3 | C | 724 | 1250 | 33% | 33% | 33% | 802 | 0.045 | >1000 | 3.90 | 670 | 3.5 | 80 | RT | Inventive |
| 4 | D | 739 | 1250 | 33% | 33% | 33% | 900 | 0.25 | >1000 | 4.0 | 710 | 5.5 | 80 | RT | Inventive |
| 5 | E | 752 | 1200 | 32% | 26% | 22% | 838 | 0.045 | >1000 | 2.31 | 670 | 10.0 | 60 | 500 | Inventive |
| 6 | F | 749 | 1250 | 33% | 33% | 33% | 780 | 0.055 | 850 | 2.46 | 650 | 3.5 | 70 | RT | Compar. |
| 7 | G | 818 | 1200 | 32% | 26% | 22% | 830 | 0.035 | >1000 | 2.30 | 670 | 7.8 | 35 | RT | Compar. |
| 8 | H | 719 | 1250 | 33% | 33% | 33% | 835 | 0.051 | >1000 | 3.12 | 630 | 5.0 | 70 | RT | Compar. |
| 9 | I | 714 | 1250 | 25% | 25% | 22% | 850 | 0.045 | >1000 | 1.00 | 680 | 5.0 | 65 | RT | Compar. |
| 10 | J | 744 | 1250 | 30% | 30% | 30% | 815 | 0.046 | >1000 | 2.48 | 640 | 3.5 | 100 | RT | Inventive |
| 11 | K | 747 | 1250 | 30% | 30% | 30% | 850 | 0.10 | >1000 | 2.50 | 690 | 3.5 | 85 | RT | Inventive |
| 12 | L | 736 | 1250 | 32% | 32% | 32% | 830 | 0.035 | >1000 | 2.45 | 650 | 3.5 | 80 | RT | Inventive |
| 13 | A | 741 | 1250 | 30% | 30% | 30% | 870 | 3.5 | 150 | 5.50 | 650 | 5.0 | 70 | RT | Compar. |
| 14 | E | 752 | 1200 | 20% | 20% | 11% | 826 | 0.45 | >1000 | 3.90 | 700 | 5.0 | 40 | 650 | Compar. |
| 15 | A | 741 | 1200 | 30% | 30% | 30% | 826 | 0.045 | >1000 | 2.45 | 650 | 1.0 | 40 | RT | Inventive |

The metallographic structure and mechanical properties of the hot-rolled steel sheets of Runs Nos. 1-15 were measured by the procedures explained below.

static-dynamic difference ΔTS of at least 80 MPa were considered acceptable.

The results of measurements are shown in Table 3.

TABLE 3

| Run No. | Ferrite fraction | Average grain diameter of ferrite (μm) | Remaining structure (second phase or phases) | Second phase spacing in sheet thickness direction (μm) | Second phase spacing in rolling direction (μm) | Static TS (MPa) | Static EL (EL) | Static TS × EL (MPa · %) | Δ TS at ε $10^3$/sec (MPa) | Remarks |
|---|---|---|---|---|---|---|---|---|---|---|
| 1 | 57% | 1.3 | bainite, retained austenite | 1.4 | 1.5 | 903 | 15.0 | 13545 | 159 | Inventive |
| 2 | 70% | 1.2 | bainite, retained austenite | 1.9 | 2 | 797 | 30.0 | 23910 | 120 | Inventive |
| 3 | 30% | 1.2 | martensite | 1.3 | 1.4 | 1400 | 12.0 | 16800 | 85 | Inventive |
| 4 | 54% | 2.2 | martensite | 2.4 | 2.6 | 1270 | 13.2 | 16764 | 100 | Inventive |
| 5 | 37% | 1.4 | bainite retained austenite | 1.8 | 2 | 804 | 17.1 | 13748 | 121 | Inventive |
| 6 | 42% | 0.75 | martensite | 0.73 | 0.9 | 956 | 15.4 | 14722 | 60 | Compar. |
| 7 | 90% | 2.9 | martensite | 6.9 | 7.5 | 705 | 20.0 | 14100 | 90 | Compar. |
| 8 | 25% | 1.8 | martensite | 2 | 2.4 | 1606 | 6.0 | 9636 | 40 | Compar. |
| 9 | 18% | 1.2 | martensite | 1.6 | 1.7 | 1580 | 4.5 | 7110 | 43 | Compar. |
| 10 | 47% | 1.1 | martensite | 1.9 | 2 | 1145 | 15.8 | 18091 | 125 | Inventive |
| 11 | 43% | 1.8 | martensite | 2.2 | 2.5 | 1164 | 15.6 | 18158 | 110 | Inventive |
| 12 | 42% | 1.3 | martensite | 1.8 | 1.9 | 1155 | 15.1 | 17441 | 120 | Inventive |
| 13 | 12% | 3.2 | martensite | 5.6 | 14.6 | 917 | 10.8 | 9904 | 65 | Compar. |
| 14 | 94% | 2.8 | cementite, pearlite | 3 | 4.5 | 615 | 27.5 | 16913 | 115 | Compar. |
| 15 | 55% | 1.3 | martensite | 1.5 | 1.6 | 1090 | 19.5 | 21255 | 165 | Inventive |

[Metallographic Structure]

The metallographic structure in a region of 100-200 μm from the surface layer of a cross section in the lengthwise direction of rolling which has been mirror polished and etched with a nital solution was measured based on a digital image taken by a scanning electron microscope at 1,000-2,000×.

The average grain diameter of ferrite was the average of the ferrite grain diameter obtained by the intercept method.

The average spacing in the sheet thickness direction of the remaining structure was determined by drawing a line with a length of 80 μm in the sheet thickness direction, measuring the spacing in the sheet thickness direction between facing second phases, repeating these procedures at 5 arbitrary locations, and calculating the average of the measured values.

The ferrite fraction was determined using the fact that martensite and bainite phases are darker than ferrite in a SEM image, namely, by converting the digital image to binary values by image processing and calculating the percentage of ferrite by area.

[Mechanical Properties]

Formability was evaluated by carrying out a tensile test on a JIS No. 5 tensile test piece. Samples which had a good balance of strength and formability as indicated by a value of at least 13,000 MPa·% for the product of tensile strength and elongation at rupture were considered acceptable.

Dynamic deformation properties (static-dynamic difference) were evaluated by preparing a minute test piece (TP) as shown in FIG. 1 and measuring a tensile strength using a stress sensing block-type high strain rate tensile testing apparatus. In view of the fact that the strength difference ΔTS between the tensile strength at a tensile strain rate of $10^3$ $sec^{-1}$ and the tensile strength at a tensile strain rate of 0.01 $sec^{-1}$ for a conventional steel of a 780-980 MPa grade is generally around 60 MPa, steels which had a high In Table 3, Runs Nos. 1-5, 10-12, and 15 used slabs having chemical compositions A-E and J-L which satisfied the chemical composition of the present invention, and they also satisfied the manufacturing conditions according to the present invention. It can be seen that as a result, they had a high strength of 750 MPa, improved formability indicated by TS×EL≥13,000 (MPa·%), and increased dynamic deformation properties (static-dynamic difference) of at least 80 MPa.

In contrast, Run No. 6 used a slab having chemical composition F which did not satisfy the chemical composition according to the present invention. Although it exhibited a relatively high static TS and static EL, it contained a large amount of Ti which is a precipitation strengthening element, so the static-dynamic difference was a low value like that of a conventional material.

Runs Nos. 7-9 used slabs having chemical compositions G-I which did not satisfy the chemical composition according to the present invention. As a result, they did not have both a high static strength and elongation and a high static-dynamic difference.

Run No. 13 used a slab having chemical composition A which satisfied the composition according to the present invention, but the rolling conditions did not satisfy the manufacturing conditions according to the present invention. Accordingly, it did not have sufficient precipitation of fine ferrite, it showed a low static elongation and a low static-dynamic difference.

Run No. 14 used a slab having chemical composition E which satisfied the composition according to the present invention, but the coiling conditions did not satisfy the manufacturing conditions according to the present invention. As a result, although a relatively high elongation and static-dynamic difference were obtained, the static strength was a low value of 615 MPa.

Example 2

The steel sheets of Runs Nos. 1-4, 6, 7, 13, and 15 which were hot rolled and cooled in Example 1 underwent cold rolling and annealing under the conditions shown in Table 4, and then they were coiled at the coiling temperatures shown in Table 2 to manufacture the cold-rolled steel sheets of Runs Nos. 18-31 in Table 4.

Table 5 shows the results of measurement of the metallographic structure and the mechanical properties of the cold-rolled steel sheets of Runs Nos. 18-31. The methods of measuring the metallographic structure and the mechanical properties were the same as the measurement methods in Example 1.

TABLE 4

| Run No. | Steel | Hot rolled steel sheet No. (Run No. in Table 3) | $Ac_3$ (° C.) | $Ac_1$ (° C.) | Reduction ratio in cold rolling | Annealing temp. (° C.) | Annealing preiod (sec) | Slow cooling rate (° C./sec) | Temp at start of rapid cooling (° C.) | Rapid cooling rate (° C./sec) | Temp at stop of rapid cooling (° C.) | Holding period (sec) | Remarks |
|---|---|---|---|---|---|---|---|---|---|---|---|---|---|
| 18 | A | 1 | 831 | 733 | 50 | 795 | 90 | 5 | 700 | 50 | 350 | 300 | Inventive |
| 19 | B | 2 | 930 | 663 | 65 | 800 | 90 | 2 | 700 | 50 | 350 | 300 | Inventive |
| 20 | F | 6 | 839 | 733 | 50 | 800 | 90 | 5 | 700 | 50 | 300 | 300 | Compar. |
| 21 | A | 13 | 831 | 733 | 50 | 800 | 90 | 5 | 700 | 50 | 350 | 300 | Compar. |
| 22 | A | 15 | 831 | 733 | 50 | 620 | 90 | — | 620 | 50 | RT | — | Compar. |
| 23 | A | 1 | 831 | 733 | 50 | 900 | 300 | 5 | 730 | 50 | 250 | 300 | Compar. |
| 24 | D | 4 | 828 | 739 | 70 | 780 | 120 | 5 | 700 | 50 | 320 | 300 | Inventive |
| 25 | A | 1 | 831 | 733 | 50 | 800 | 10 | 5 | 700 | 50 | 300 | 300 | Inventive |
| 26 | G | 7 | 919 | 707 | 50 | 850 | 90 | 5 | 730 | 50 | 400 | 300 | Compar. |
| 27 | A | 15 | 831 | 733 | 50 | 800 | 90 | 5 | 670 | 50 | 350 | 300 | Inventive |
| 28 | A | 1 | 831 | 733 | 50 | 810 | 90 | 5 | 700 | 50 | 400 | 300 | Inventive |
| 29 | A | 1 | 831 | 733 | 50 | 750 | 1000 | 6 | 700 | 50 | 370 | 300 | Compar. |
| 30 | A | 1 | 831 | 733 | 50 | 740 | 10 | 5 | 670 | 50 | 250 | 300 | Inventive |
| 31 | C | 3 | 812 | 726 | 25 | 800 | 50 | 5 | 700 | 50 | 370 | 300 | Compar. |

TABLE 5

| Run No. | Ferrite fraction | Average grain diameter of ferrite (μm) | Remaining structure (second phase or phases) | Second phase spacing in sheet thickness direction (μm) | Second phase spacing in rolling direction (μm) | static TS (MPa) | static EL (EL) | static TS × EL (MPa · %) | Δ TS at ε $10^3$/sec (MPa) | Remarks |
|---|---|---|---|---|---|---|---|---|---|---|
| 18 | 57% | 1.7 | bainite, tempered martensite | 2.1 | 2.2 | 880 | 20.4 | 17952 | 132 | Inventive |
| 19 | 63% | 1.6 | bainite, tempered martensite | 1.7 | 1.8 | 968 | 17.9 | 17327 | 128 | Inventive |
| 20 | 56% | 1.8 | tempered martensite | 1.9 | 2.0 | 961 | 17.6 | 16914 | 65 | Compar. |
| 21 | 62% | 3.8 | bainite, tempered martensite | 4.2 | 6.3 | 825 | 16.7 | 13778 | 72 | Campar. |
| 22 | 56% | Unmeasurable* | cementite | Unmeasurable* | Unmeasurable* | 1138 | 8.0 | 9104 | 38 | Compar. |
| 23 | 12% | 3.2 | tempered martensite | 4.0 | 4.3 | 1250 | 10.0 | 12500 | 45 | Compar. |
| 24 | 59% | 1.5 | tempered martensite | 1.8 | 1.9 | 980 | 14.4 | 14112 | 160 | Inventive |
| 25 | 57% | 1.9 | tempered martensite | 2.1 | 2.2 | 937 | 20.0 | 18740 | 102 | Inventive |
| 26 | 90% | 3.0 | bainite | 6.8 | 7.1 | 583 | 29.0 | 16907 | 93 | Compar. |
| 27 | 64% | 2.9 | bainite, tempered martensite | 2.2 | 2.3 | 885 | 20.7 | 18320 | 90 | Inventive |
| 28 | 68% | 1.8 | bainite | 2.5 | 2.7 | 775 | 24.8 | 19220 | 107 | Inventive |
| 29 | 51% | 4.5 | bainite, tempered martensite | 4.8 | 5.8 | 820 | 18.2 | 14924 | 75 | Compar. |
| 30 | 63% | 1.0 | tempered martensite | 1.2 | 1.8 | 856 | 15.5 | 13268 | 175 | Inventive |
| 31 | 60% | 5.6 | bainite | 6.2 | 7.4 | 813 | 14.8 | 12032 | 72 | Compar. |

*Unmeasurable due to a deformed texture

As shown in Table 5, the cold-rolled steel sheets of Runs Nos. 18, 19, 24, 25, 27, 28, and 30 were manufactured by carrying out cold rolling and annealing under conditions within the range of the present invention on hot-rolled steel sheets manufactured under the conditions within the range of the present invention. It can be seen that the cold-rolled steel sheets of Runs Nos. 18, 19, 24, 25, 27, 28, and 30 had a high strength of 750 MPa, improved formability indicated by TS×EL≥13,000 (MPa·%), and good dynamic deformation properties (static-dynamic difference) of at least 80 MPa.

In contrast, Run No. 20 used a slab having composition F which did not satisfy the chemical composition according to the present invention. Although it exhibited a relatively high static TS and static EL, in the same manner as Run No. 6 in Table 3, its static-dynamic difference was a low value like that of a conventional material due to the presence of a large amount of Ti which is a precipitation strengthening element.

In Run No. 21, since a coarse-grained hot-rolled steel sheet (the hot-rolled sheet of Run No. 13) having a ferrite grain diameter exceeding 3.0 μm was used as a steel sheet for cold rolling, ferrite was still coarse after cold rolling and annealing, and the static-dynamic difference was a low value like that of a conventional material.

In Run No. 22, a steel sheet of Run No. 15 which satisfied the present invention was used as a steel sheet for cold rolling, but annealing was carried out at a low temperature. As a result, the deformed structure formed by cold rolling remained after annealing, and the average grain diameter of ferrite and the average spacing in the sheet thickness direction of the remaining structure could not be measured. The steel sheet of Run No. 22 had an extremely low elongation, and its static-dynamic difference was also low.

Run No. 23 used a steel sheet of Run No. 1 which satisfied the present invention as a steel sheet for cold rolling, and annealing was carried out at a high temperature. As a result, ferrite became coarse and the dynamic tensile strength was low.

Run No. 26 used a slab of Composition G which did not satisfy the composition according to the present invention, so the ferrite fraction after cold rolling was high and the static strength was low.

Run No. 29 used Run No. 1 which satisfied the present invention as a steel sheet for cold rolling, and annealing was carried out for a long time (holding time) which exceeded 300 seconds, thereby coarsening ferrite. In addition, the average spacing in the sheet thickness direction of the remaining structure was large. Therefore, the static-dynamic difference was low.

In Run No. 31, a steel sheet of Run No. 3 which satisfied the present invention was subjected to cold rolling with a low rolling reduction of 25%. As a result, coarse ferrite which is considered to be a recovered structure was observed, and the average spacing in the sheet thickness direction of the remaining structure was large. Therefore, formability and the static-dynamic difference were both low.

INDUSTRIAL APPLICABILITY

A steel sheet according to the present invention has ultrafine ferrite grains, and the remaining structure (the second phase) is uniformly dispersed. Therefore, the steel sheet is suitable not only for use as a hot-rolled steel sheet but also for use as a starting material for a cold-rolled sheet having both formability and dynamic deformation properties after cold rolling and annealing.

A steel sheet having a tensile strength of at least 750 MPa as well as excellent press formability and dynamic deformation properties can be easily manufactured by a manufacturing method according to the present invention without worsening productivity.

The invention claimed is:

1. A hot rolled steel sheet having a chemical composition comprising, in mass percent, C: 0.05-0.20%, Si: 0.02-3.0%, Mn: 0.5-3.0%, P: at most 0.5%, S: at most 0.05%, Cr: 0.05-1.0%, sol. Al: 0.01-1.0%, one or more elements selected from the group consisting of Ti, Nb, Mo, V, and W: a total of 0.002-0.03%, and a remainder of Fe and impurities;

the hot rolled sheet having a hot rolled metallographic structure and a sheet thickness including a location from 100 μm to 200 μm in a sheet thickness direction from an outermost layer of the hot rolled steel sheet, wherein in the location from 100 μm to 200 μm in a sheet thickness direction from an outermost layer of the hot rolled steel sheet, the metallographic structure consists of 30-80% by area of a ferrite and a remaining structure, wherein the average grain diameter of ferrite is at most 2.2 μm, the remaining structure is selected from the group consisting of one of bainite, martensite, tempered martensite, retained austenite, and a combination of bainite and retained austenite, and throughout the location, the remaining structure has an average spacing in the thickness direction and an average spacing in the rolling direction of at most 3.0 μm, wherein a product of a tensile strength and an elongation at rupture for the hot rolled steel sheet is at least 17,000 MPa %, and the tensile strength is at least 750 MPa.

2. A hot rolled steel sheet as set forth in claim 1 wherein the chemical composition further contains, in mass percent, one or more of Ca, Mg, and rare earth elements in a total amount of at most 0.0050%.

3. A hot rolled steel sheet as set forth in claim 1 wherein a difference between a dynamic tensile strength measured at a tensile strain rate of $10^3$ $sec^{-1}$ and a static tensile strength measured at a tensile strain rate of 0.01 $sec^{-1}$ is at least 80 MPa.

* * * * *